US007189933B2

(12) United States Patent
Yu

(10) Patent No.: US 7,189,933 B2
(45) Date of Patent: Mar. 13, 2007

(54) SOLID INSULATED DISCONNECTION SWITCH

(75) Inventor: Lyun Yu, Cheongju (KR)

(73) Assignee: LS Industrial Systems Co., Ltd., Seoul (KR)

( * ) Notice: Subject to any disclaimer, the term of this patent is extended or adjusted under 35 U.S.C. 154(b) by 0 days.

(21) Appl. No.: 11/382,984

(22) Filed: May 12, 2006

(65) Prior Publication Data

US 2006/0254890 A1 Nov. 16, 2006

(30) Foreign Application Priority Data

May 13, 2005 (KR) ..... 10-2005-0040318

(51) Int. Cl.
*H01H 31/02* (2006.01)

(52) U.S. Cl. ..... 200/48 R; 200/501; 218/154

(58) Field of Classification Search ..... 200/1 R, 200/11 R–11 TC, 19.01, 19.06, 19.07, 19.18, 200/48 R, 16, 500, 501, 572, 253.1; 218/12, 218/67, 80, 79, 120, 140, 154
See application file for complete search history.

(56) References Cited

U.S. PATENT DOCUMENTS 3,801,768 A * 4/1974 Meyer ..... 200/253.1
3,957,495 A * 5/1976 Teranishi et al. ..... 106/31.16
4,808,777 A * 2/1989 Kindberg et al. ..... 200/323
4,983,792 A * 1/1991 Rogers et al. ..... 218/84
5,850,909 A * 12/1998 Wagner ..... 200/501

* cited by examiner

*Primary Examiner*—Elvin Enad
*Assistant Examiner*—M. Fishman
(74) *Attorney, Agent, or Firm*—Greenblum & Bernstein, P.L.C.

(57) ABSTRACT

Provided is a solid insulated disconnection switch including a base frame to which outside electrical equipment is electrically connected, a driving assembly generating rotating power, a shaft of which an outside surface has a screw thread and which is rotated by the rotating power generated by the driving assembly, a stator having a fixed contact point which is electrically connected to a main bus, a mover which is electrically connected to the external connection outlet of the base frame and moves back and forth in a straight line between the fixed contact point of the stator and a position which is separately disconnected from the fixed contact point of the stator by rotating the shaft, a spacer which is provided between the base frame and the stator, and a power transfer assembly which is provided between the driving assembly and the shaft to transfer the rotating power generated from the driving assembly to the shaft. The present invention makes it possible to reduce a size of the disconnection switch by using insulating solid material barriers between components of the disconnection switch instead of the insulating gas.

17 Claims, 10 Drawing Sheets

SOLID INSULATED DISCONNECTION SWITCH

BACKGROUND OF THE INVENTION

1. Field of the Invention

The present invention relates to a disconnection switch which constitutes a make/break apparatus, and more particularly to an solid insulated disconnection switch whose a size is reduced by employing an insulating solid, compared to the size of a conventional disconnection switch.

2. Description of the Background Art

A disconnection switch serves to break off a circuit after stopping a flow of an electric current and is different from a load/break switch in that the disconnection switch does not stop and allow the flow of the current. The disconnection switch is a component of a make/break apparatus which is installed in a power-transmission site or a substation to break off the circuit when a connection to a main circuit need to be changed with the flow of the current being stopped.

The disconnection switch is housed in an airtight metal container whose an inside is filled with an insulating material such as air, or a SF6 gas having more insulative effect than air, in order to keep the main circuits insulated from each other or the earth.

The disconnection switch comes in many switching structures, which performs the connection to and disconnection from the main circuit, with the flow of the electric current being stopped. The disconnection switch within the make/brake apparatus using the SF6 gas, as shown in FIG. 1, is now described.

FIG. 1A is a front view illustrating that the conventional disconnection switch is in a disconnected state. FIG. 1B is a front view illustrating that the conventional disconnection switch is in a disconnected state. FIG. 2 is a plane view of the conventional disconnection switch as shown in FIG. 1A.

The disconnection switch includes a main bus 201 provided in the inside of an container 210 which is filled with an insulating gas, a stator 230 fixed to the main bus 201, a mover 220 which rotates to be connected to or be disconnected from the stator 230 and is coupled to a bushing 202, a driving unit 260 driving the mover 220, a power transfer shaft 240 transferring power generated from the driving unit 260, and a linker 250 which transfers the power to and maintains a disconnection from the main circuit.

FIG. 1A is a front view illustrating that the conventional disconnection switch is in a disconnected state. The disconnected state means that the disconnection switch is disconnected from the main circuit, more specifically that the mover 220 is disconnected from the stator 230.

The driving unit 260 driven by a motor, when receiving an electric connection signal in the disconnected state, rotates the power transfer shaft 240, for example, by 50 degrees counterclockwise. As a result, the linker 250, which is connected to the power transmission shaft 240 using a pin, moves downwards and rotates by 50 degrees counterclockwise to a place where the linker 250 is positioned as shown in FIG. 1B. Accordingly, the mover 220 is coupled to the stator 230, so that the main bus 201, the stator 230, the mover 220, and the bushing 202 are electrically connected to each other, making it possible to operate the make/brake apparatus. This is hereinafter referred to as "the connected state"

Conversely, the driving unit 260, when receiving an electric disconnection signal in the connected state, rotates the power transfer shaft 240, for example, by 50 degrees clockwise. As a result, the linker 250, which is connected to the power transfer shaft 240 using a pin, moves upwards and rotates by 50 degrees clockwise to create the disconnected state that the mover 220 are disconnected from the stator 230.

In the make/brake apparatus having double main buses, the disconnection switch is provided to each of the double main buses. So, when one main bus is in trouble, it is possible to provide electric power using the other main bus. The arrangement of the double main buses in the make/brake apparatus depends on the positional relationship between the main bus and the container 210. The main buses are practically provided in parallel to each other.

The recent trend towards automation, miniaturization, high reliability, and low cost requires the make/brake apparatus including the above disconnection switch to be developed in such a way as to follow the recent trend.

To that end, in addition to performing a basic function of changing the connection to the main circuit with the flow of the electric current being stopped, the disconnection switch has to minimize an insulation space required between the main circuits (corresponding to phases) and between the main circuit and the earth to reduce the size of the make/brake apparatus.

However, the use of the gas places as the insulating material imposes a limitation on reducing the size of the make/brake apparatus including the disconnection switch.

The reduction of the size of the disconnection switch has been achieved by providing insulating solid material barriers between some components of the disconnection switch instead of using the insulating gas, or increasing the gas pressure to maintain the insulation between the components of the disconnection switch. This makes it possible to largely reduce the size of the disconnection switch and requires everyday maintenance operations such as the cleaning of main buses, the checking of the gas pressure, or the like. The use of SF6 gas as the insulating gas in the disconnection switch is regulated worldwide, because SF6 gas is the main culprit increasing the atmosphere temperature.

BRIEF DESCRIPTION OF THE INVENTION

Therefore, an object of the present invention is to provide a disconnection switch whose a size is reduced by using an insulating solid material instead of an insulating gas, thereby increasing interoperability and reliability.

To achieve these and other advantages and in accordance with the purpose of the present invention, as embodied and broadly described herein, there is provided a disconnection switch including a base frame made of an insulating solid material which is tunneled in one direction and has inside an external connection outlet to which outside electrical equipment is electrically connected, a driving assembly generating rotating power, a shaft made of the insulating solid material, of which an outside surface has a screw thread and which is rotated by the rotating power generated by the driving assembly, a stator having a fixed contact point which is electrically connected to a main bus and is surrounded by the insulating solid material, a mover which is electrically connected to the external connection outlet of the base frame through the screw-thread engagement of the mover with the shaft and which moves back and forth in a straight line between the fixed contact point of the stator and a position which is separately disconnected from the fixed contact point of the stator by rotating the shaft, a spacer made of the insulating solid material, which is provided between the base frame and the stator to electrically insulate the base frame from the stator and has an empty space inside to allow the mover to pass through, and a power transfer assembly which is provided between the driving assembly and the shaft to transfer the rotating power generated from the driving assembly to the shaft and electrically insulate the driving assembly from the shaft.

The foregoing and other objects, features, aspects and advantages of the present invention wilt become more apparent from the following detailed description of the present invention when taken in conjunction with the accompanying drawings.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE INVENTION

Reference will now be made in detail to the preferred embodiments of the present invention, examples of which are illustrated in the accompanying drawings.

Figure 3:
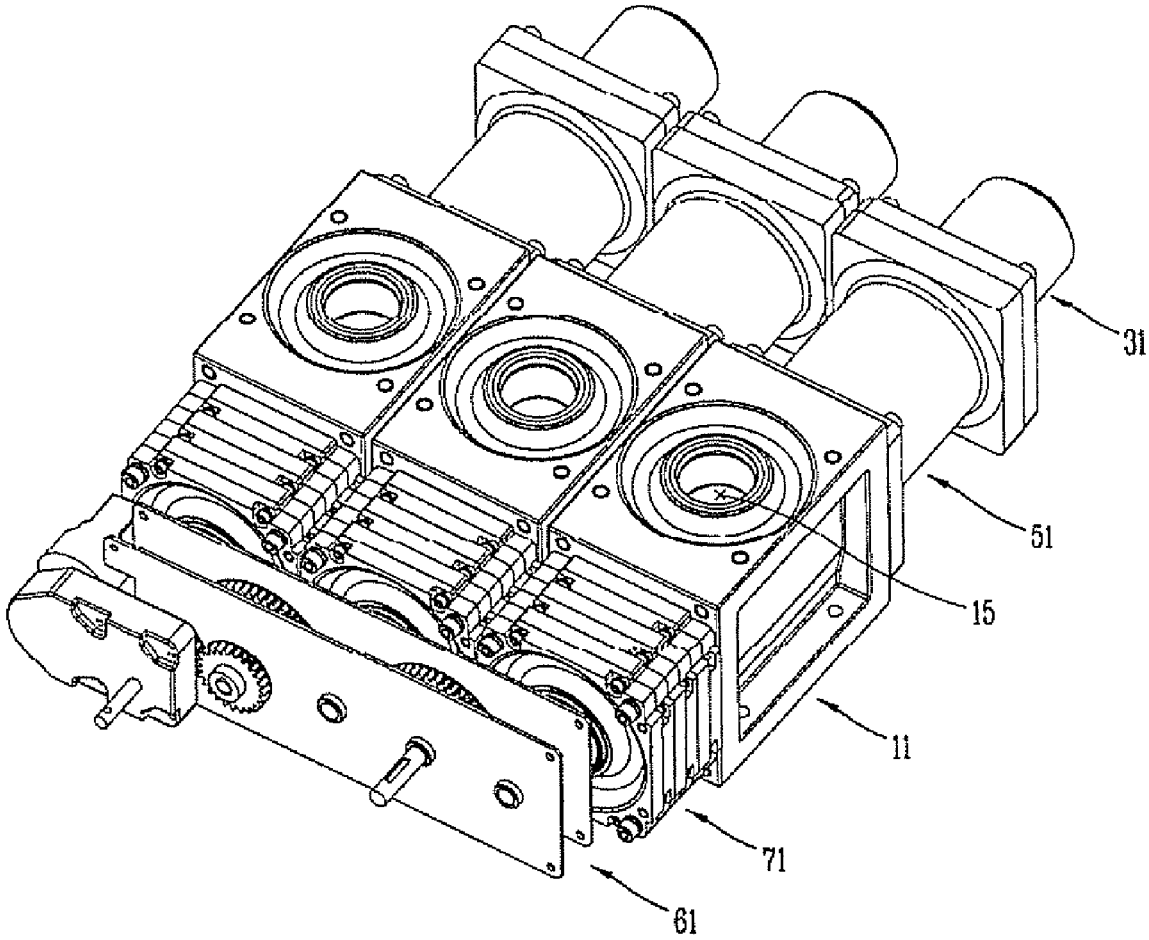
FIG. 3 is an exploded perspective view of assembled disconnection switches according to an embodiment of the present invention.
Figure 4A:
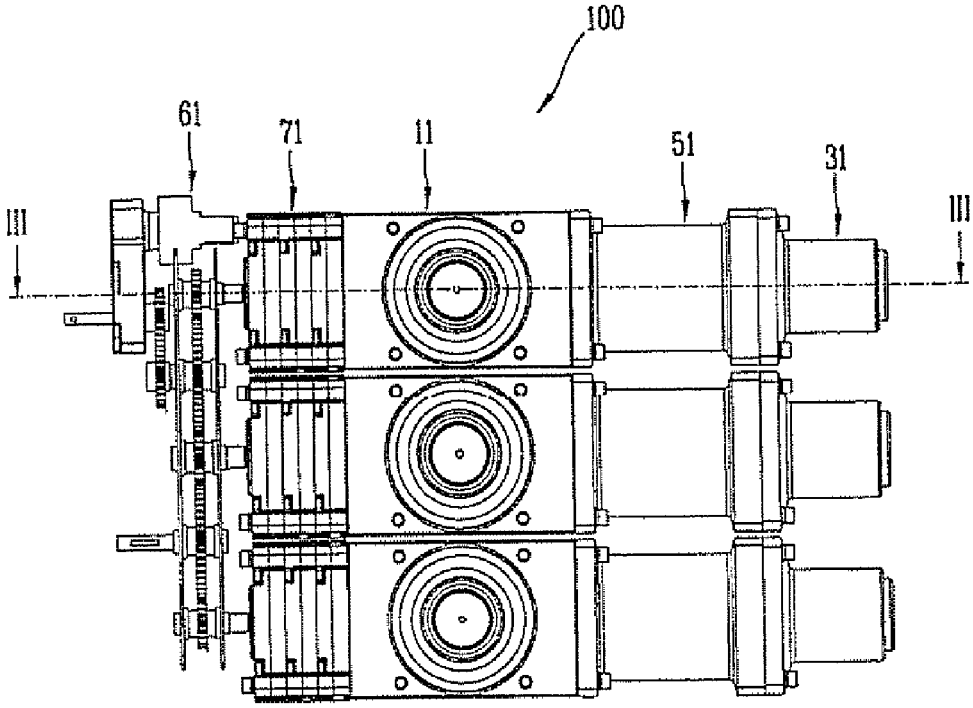
FIG. 4A is a plane view of the disconnection switches as shown in FIG. 3.
Figure 4B:
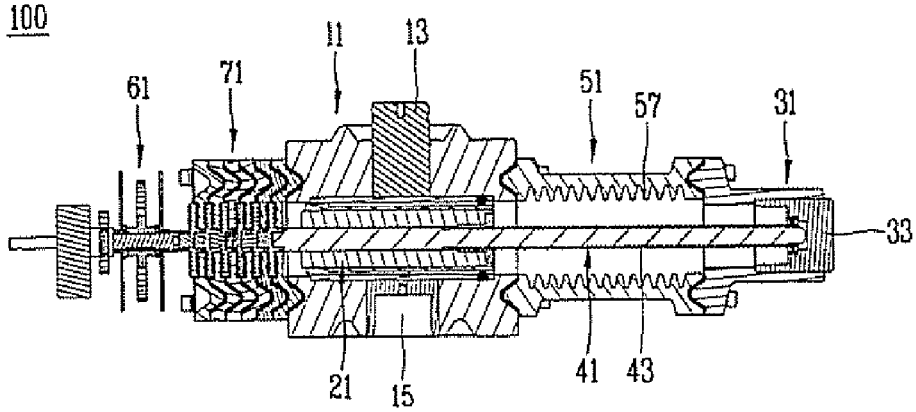
FIG. 4B is a cross sectional view taken along III—III line of FIG. 4A illustrating the disconnected state of the disconnection switch.
Figure 5:
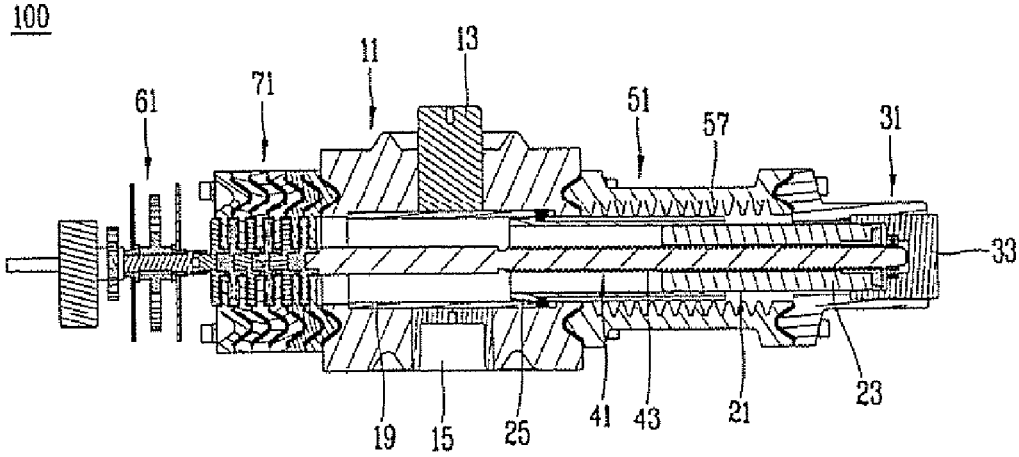
FIG. 5 is a cross sectional view of FIG. 4B illustrating the disconnected state of the disconnection switch.

FIG. 3 is an exploded perspective view illustrating assembled disconnection switches according to an embodiment of the present invention. FIG. 4A is a plane view of FIG. 3. FIG. 4B is a cross sectional view taken along III—III line of FIG. 4A illustrating a disconnected state of the disconnection switch. FIG. 5 is a cross sectional view of FIG. 4B illustrating the disconnected state of the disconnection switch.

As shown in FIG. 3 to FIG. 5, the make/brake apparatus to which three phase alternating current is applied includes three disconnection switches 100 provided in parallel with each other, with each corresponding to each of three phase alternating current.

The disconnection switch 100 includes a base frame 11 providing an external connection outlet to which outside electrical equipment is electrically connected, a stator 31 connecting to a main bus, a mover 21 movable in a straight line between the fixed contact point of the stator 31 and a position which is separately disconnected from the fixed contact point of the stator 31, a shaft transferring power to the mover 21, a spacer 51 providing an insulating distance between the mover 21 and the stator 32 in the disconnected state, a driving assembly 61 providing rotating power, and a power transfer assembly 71 transferring the rotating power generated from the driving assembly 61 to the shaft 41.

The base frame 11, as shown in FIG. 5 is made of the insulating solid material and is tunneled in one direction. The base frame 11 includes external connection outlets 13 have and 15 having a conductor which serves to transfer electric current from the stator 31 to outside equipment. The external connection outlets 13 and 15 include a protruding outlet 13 which is inserted into a conductor of the outside equipment for electrical connection and a receding outlet 15 into which the conductor of the equipment is inserted for electrical connection. The mover 21, when disconnected from the stator 31, is positioned into the inside empty space of the base frame 11. More specifically, a circle-shaped base frame conductor 19 is fixed along an inner surface of the base frame 11 to electrically connect to the external connection outlets 13 and 15 including the protruding outlet 13 and the receding outlet 15. A moving conductor 25 on the mover 21 is slid into the inside empty space of the base frame conductor 19. The external connection moving conductor 25 maintains an electrical contact with the base frame conductor 19 during the sliding of the external connection moving conductor 25 into the inside empty space of the base frame conductor 19. While the external connection moving conductor 25 is slid back and forth in the inside empty space of the base frame conductor 19, the external connection moving conductor 25 is always electrically connected to the base frame conductor 19 through a contact of the inside surface of the base frame conductor 19 with an external connection contact band 28 which is provided along a outside surface of the external connection moving conductor 25. The contact band is a commercial product available as a trademark "Multi-Band" on the market. The term "contact band" is short for LA-CU Multilam Contact Band manufactured by Multi Contact AG in Germany. The band contact is manufactured by connecting a plurality of thin copper plates between two long-sized stainless strips. The band contact, which has high electric conductivity, high abrasion resistance, and high heat resistance, is in wide use for turning on and off electricity through connection and disconnection operations.

Figure 6:
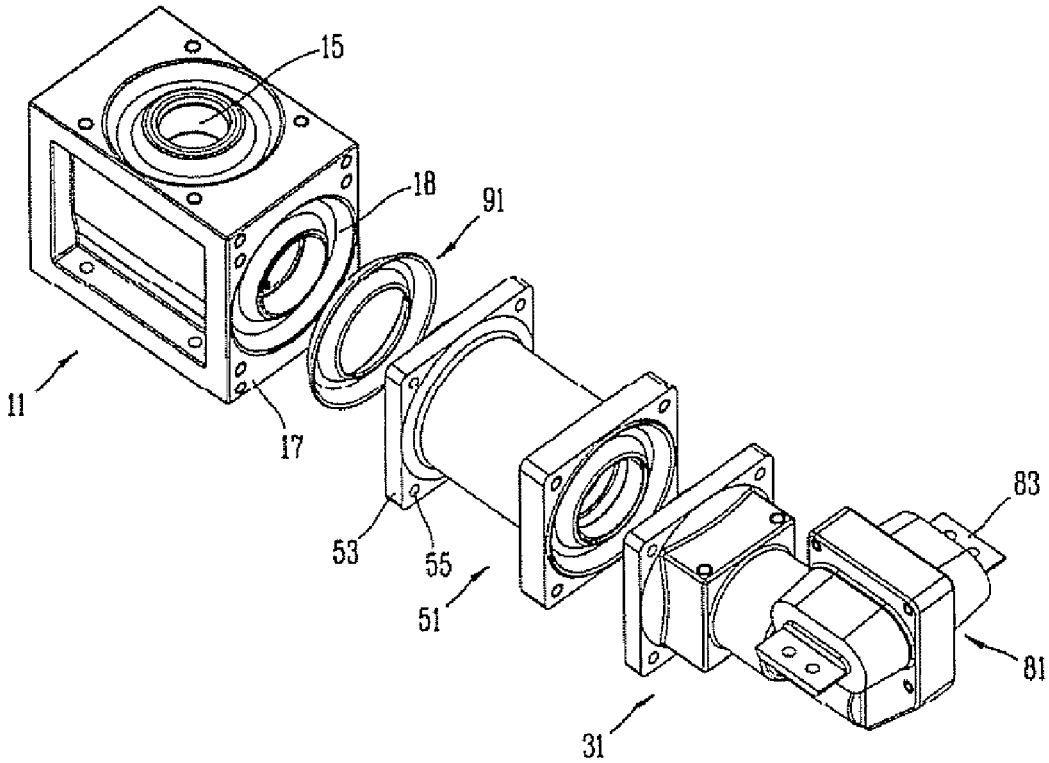
FIG. 6 is an exploded perspective view of a base frame, a spacer, a stator, and the like which are shown in FIG. 4B.
Figure 7:
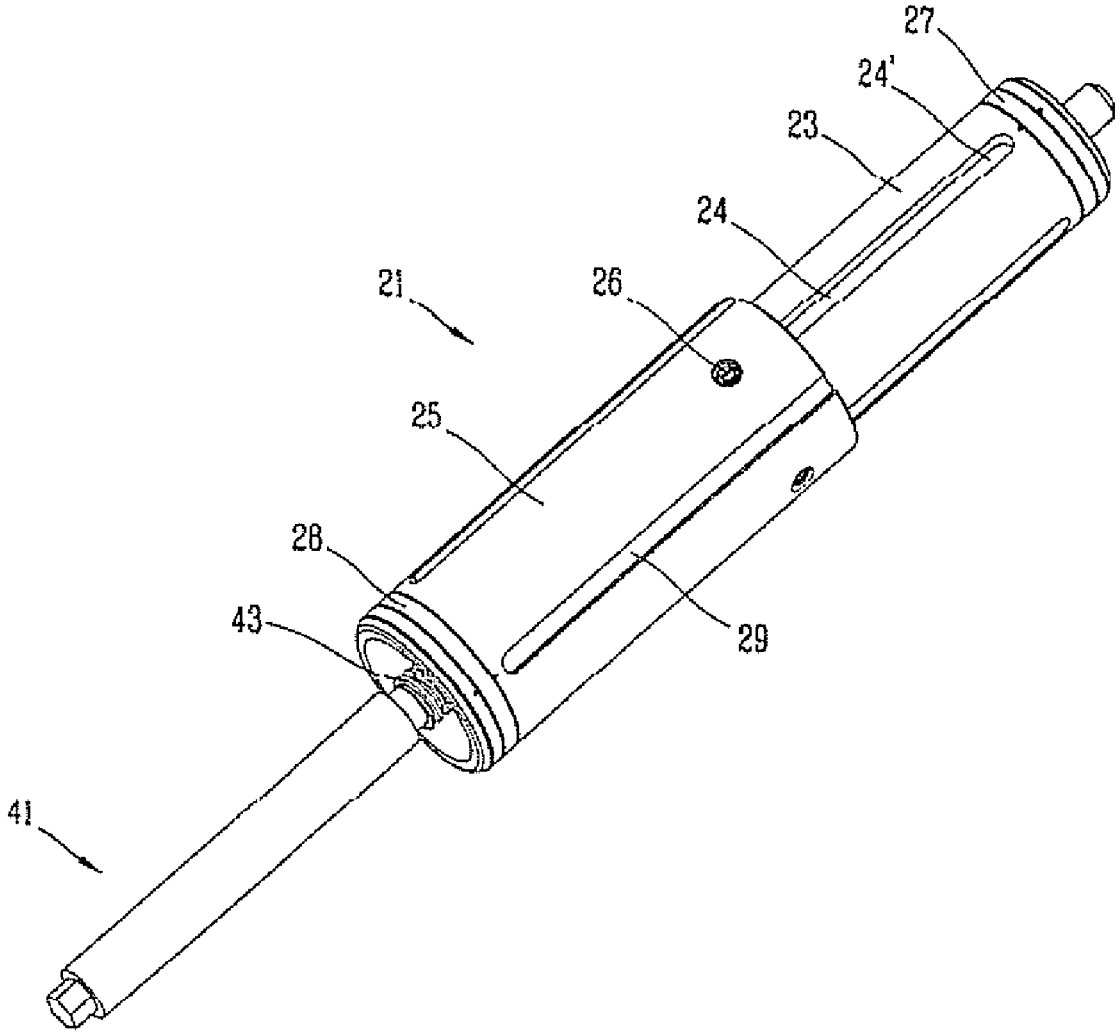
FIG. 7 is an exploded perspective view necessary to explain about a configuration and operation of the mover and the shaft.

As shown in FIG. 4B, the mover 21, when in the disconnected state, is positioned within the base frame 11. As shown in FIG. 5, the mover 21, when in the connected state, moves towards the stator 31 and remains contacted to the fixed contact point 33. Thus, a circuit is formed for supplying electrical current to the outside equipment. Over the circuit, the electrical current flows from a power supply to the outside equipment, through the main bus, a main bus connection part 81 (as shown in FIG. 6), the fixed contact point 33, the mover 21, the base frame conductor 19 of the base conductor 11, and the external connection outlets 13 and 15. Referring to FIG. 7, the mover 21 is later described in more detail.

The stator 31 is provided in one end of the disconnection switch in the direction of the length of the disconnection switch and connected to the main bus connection part 81. The stator 31, when in the connected state, is electrically connected to the mover 21 through the contact of the mover 21 to the stator 31. The mover 21 is slid into and contacted to the stator 31 which is shaped like "⊃" as shown in FIG. 5, to make an electric connection to the stator 31. One end of the shaft 41 is rotated and supported by a rotation support means such as a bearing, at a side-indented part of the stator 31.

The shaft 41 is made of enhanced plastic having high electric insulation and abrasion resistance. The shaft 41 functions as a power transfer means for moving the mover 21 between the position where the mover 21 is connected to the stator 31 (i.e., the connected state) and the position where the mover 21 is disconnected from the stator 31 (i.e., the disconnected state). There are many ways to move the mover 21 between the connected state and the disconnected state. However, the embodiment of the present invention employs the rod-shaped shaft 41 of which the inside surface has a screw thread 43 to largely reduce the space which the disconnection switch occupies. The rod-shaped shaft 41 of which the outside surface has a screw thread 43 is short in length in terms of straight line, but long in length in terms of corrugated line. This makes it possible to enable the shaft to transfer the rotating power and at the same time to reduce the space which the disconnection switch occupies. The screw thread on the outside surface of the shaft 41 are engaged with those on the inside surface of the mover 21. Thus, the rotation of the shaft, which is powered by the driving assembly 61, propels the mover 21 into the inside of the shaft 41 along the straight line. This is later in more detail described referring to FIG. 7. The shaft 41 is provided to passes through the mover 21 and the base frame 11. One end of the shaft 41 is rotated and supported by the stator 31 and the other end of the shaft 41 is driven and supported by the power transfer assembly 71.

The spacer 51 is provided between the base frame 11 and the stator 31 to secure the insulation distance as long as possible between the mover 21 and the stator 31 in the disconnected state. The spacer 51 has an empty space inside to allow the mover 21 to pass through the spacer 51. The corrugated region 57 is formed on the inside surface of the spacer 51 to increase the insulation distance in terms of the length of the corrugated surface. The formation of the corrugated region 57 on the inside surface of the spacer 51 makes it possible to largely shorten the length of the disconnection switch 100, as well as secure the necessary insulation distance.

The driving assembly 61 is provided on one end of the disconnection switch 100, with the stator 31 provided on the other end of the disconnection switch 100. The driving assembly 61 rotates the shaft 41. As above described, the rotation of the shaft 41 moves back and forth the mover 21 to connect the mover 21 to and disconnect the mover 21 from the stator 31. Referring to FIG. 61, the driving assembly 61 is later in detail described.

Figure 8A:
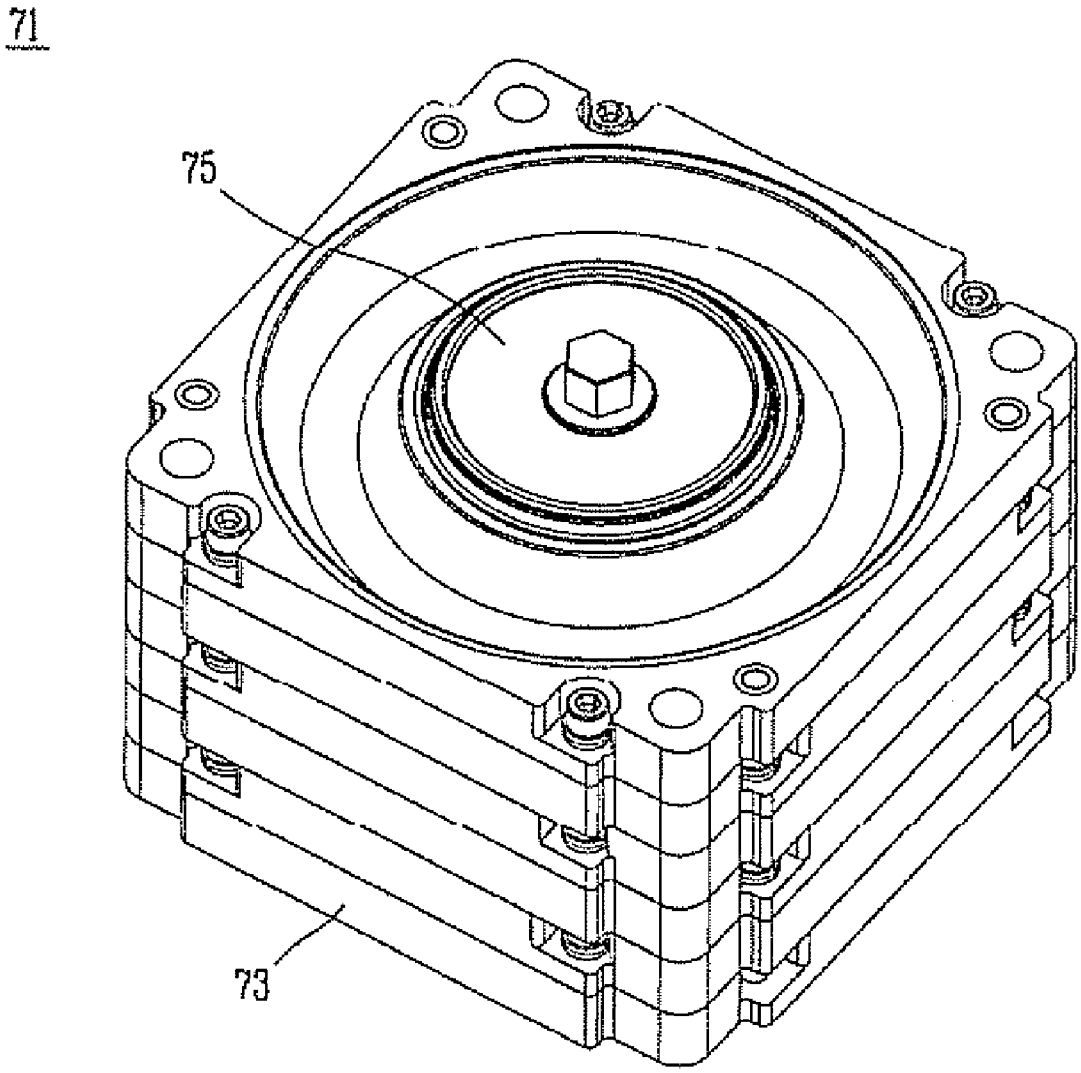
FIG. 8A is a perspective view of a power transfer assembly.

The power transfer assembly 71 is provided between the driving assembly 61 and the base frame 11 to transfer the power generated by the driving assembly 61 to the shaft 41 and insulate one open end of the base which does not face the stator 31. Referring to FIGS. 8 and 9, the power transfer assembly 71 is later in detail described.

A wrapper enclosing the base frame 11 and the stator 31, the shaft 41, the spacer 51, and the power transfer assembly 71 are all made of the insulating material. However, the internal components requiring the electrical connection are made of a metal conductor, such as the external connection outlets 13 and 15 provided within the base frame 11, the external connection band contact 28 on the mover 21, an internal connection band contact 27, the external connection moving conductor 25, an internal connection moving conductor 23, and the fixed contact point 33. There are many kinds of insulating solid materials, such as an engineering plastic, a polymer, epoxy resin or the like. The embodiment of the present invention uses the epoxy suitable for the disconnection switch requiring high insulation and mechanical strength, but not limited to the epoxy. The enhanced plastic, which has better plasticity and insulation than the epoxy, may be used as the material for forming the shaft 41. The enhanced plastic is more suitable to form the screw thread on the outside surface of the shaft 41.

The components, as shown in FIG. 5, are sequentially provided from left to right in the following order: the driving assembly 61, the power transfer assembly 71, the base frame 11, the spacer 51, and the stator 31. This arrangement of the components makes it possible to move the mover 21 between the place where the mover 21 is connected to the stator 31 and the place where the mover 21 is disconnected from the stator 31.

Figure 1A:
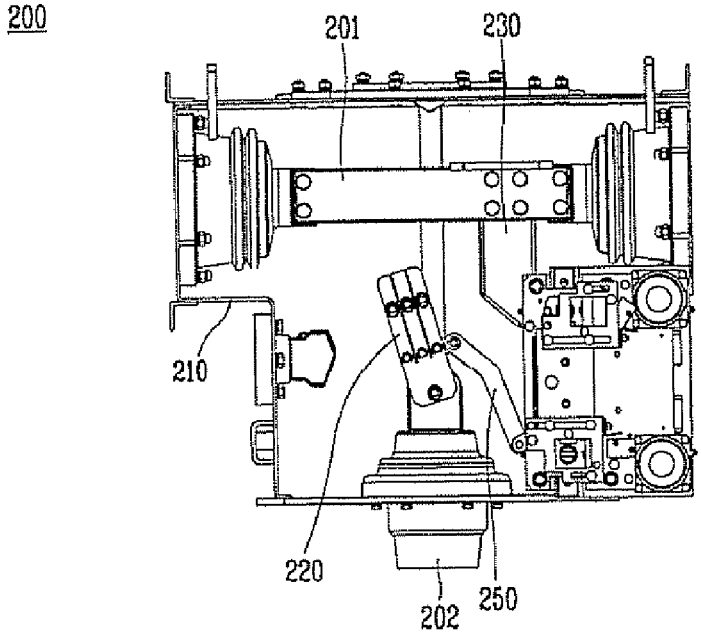
FIG. 1A PRIOR ART
FIG. 1A is a front view illustrating that a conventional disconnection switch is in a disconnected state.
Figure 1B:
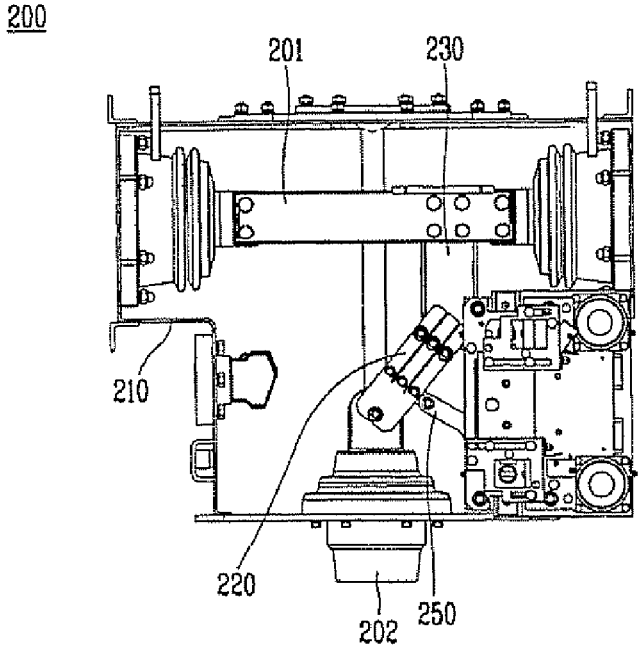
FIG. 1B PRIOR ART
FIG. 1B is a front view illustrating that the conventional disconnection switch is in a disconnected state.
Figure 2:
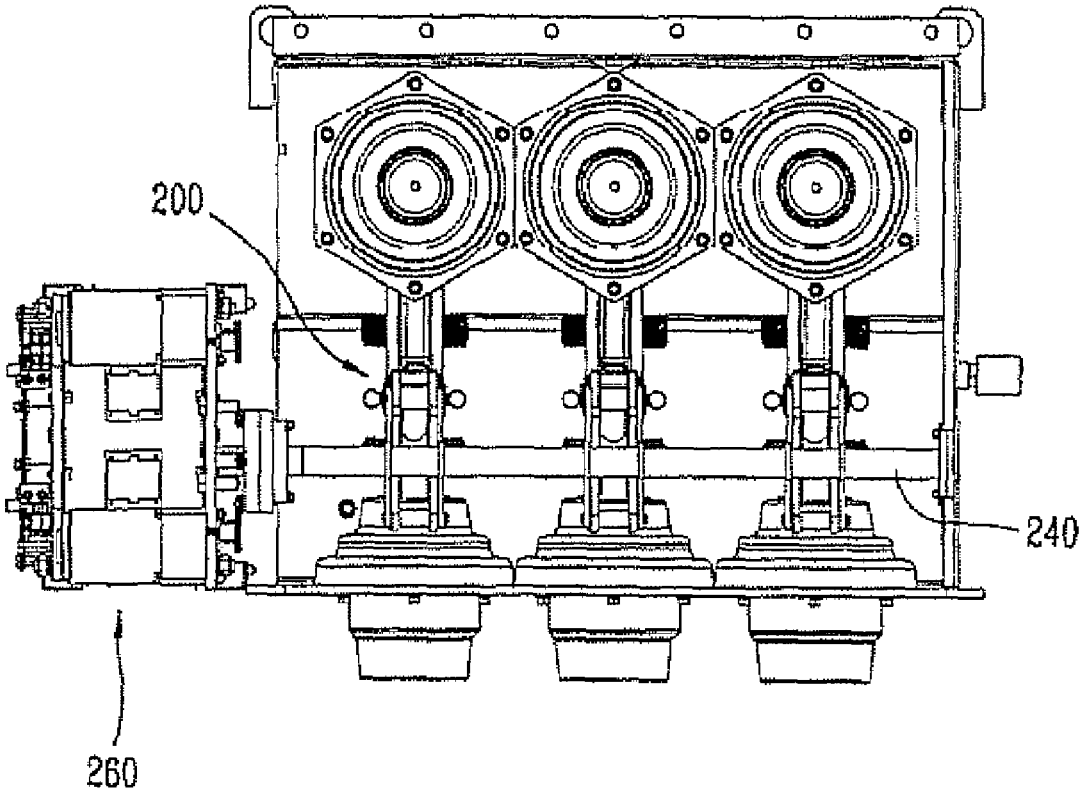
FIG. 2 PRIOR ART
FIG. 2 is a plane view of the conventional disconnection switch as shown in FIG. 1A.

This arrangement of the components may reduce the space which the disconnection switch occupies, compared to the arrangement of the components of the conventional disconnection switch, as shown in FIG. 1, where the mover 220 is connected to or disconnected from the stator 230 by the counterclockwise or clockwise rotation of the linker 250. The reduction in the size of the disconnection switch enables the reduction in the radius of the pipeline-structured container where the disconnection switch is installed. This additionally makes it possible to reduce the space which the make/brake apparatus occupies and the manufacturing cost for the make/brake apparatus.

FIG. 6 is an exploded perspective view of the base frame, the spacer, the stator, and the like which are shown in FIG. 4B.

Referring to FIG. 6, an insulating plate 91 is in detail described, which guarantees electrical insulations among the above described components.

The insulating plate 91 has an empty space inside in order for the mover 21 to pass through the insulating plate 91. Like other components such as the base frame, the insulating plate 91 is made of the insulating material. But, the insulating plate 91 has to have higher flexibility and tightness than the other components, at the expense of mechanical strength. This is because the insulating plate 91 is inserted between each of the components to prevent electric leakage due to a narrow opening between the two components. The embodiment of the present invention uses a silicone as the material for the insulating plate 91, but not limited to the silicone.

The insulating plate 91 is inserted between each of the power transfer assembly 71, the base frame 11, the spacer 51, the stator 31 which are made of the insulating material. A corrugated region is formed on the surface of the insulating plate 91 to lengthen the surface insulation distance in terms of the length of the corrugated surface. The power transfer assembly 71, the base frame 11, the spacer 51, and the contact surface of the stator 31 are formed to correspond to the corrugated region on the surface of the insulating plate 91.

The insertion of the insulating plate between the base frame and the spacer 51, for example, is described referring to FIG. 6.

A "<" shaped region is formed on the insulating plate 91 to lengthen a surface distance for insulation. Accordingly, the "<" shaped regions are formed on the contact surface 17 of the base frame 11 and the contact surface of the space 11 to contact the "<" shaped region of the insulating plate 91. The insulating plate 91 inserted between the base frame 11 and the spacer 51 provides complete insulation between the base frame 11 and the space 51. Thus, the electrical leakage due to the narrow opening between the base frame 11 and the space 51 is not permitted. A nut hole provided on the contact surface 17 of the base frame 11 and a bolt hole 55 provided on the connect plate 53 of the spacer 51 is combined using a bolt. Otherwise, the spacer 51 is welded to the base frame 11 to combine both of them.

Referring to FIG. 7, the configuration and interaction of the mover and the shaft is now described.

As shown in FIG. 7, the mover 21 includes the external connection moving conductor 25 and the internal moving conductor 23.

The screw thread formed on the inside surface of the internal connection moving conductor 23 is engaged with that formed on the outside surface of the shaft 41 which is inserted within the internal connection moving conductor 23. The internal connection band contact 27 is provided along an outer surface of the one end part of the internal connection moving conductor 23 which, when in the connected state, is connected to the fixed contact point 33. A guide slot 24 is provided on the outside surface of the internal connection moving conductor 23 in the direction of the length of the internal connection moving conductor 23.

An inside diameter of the external connection moving conductor 25 is greater than the outside diameter of the internal connection moving conductor 23. This enables the internal connection moving conductor 23 to move back and forth into the external connection moving conductor 25. The protruding outlet 13 is electrically connected to the base frame conductor 19. The external connection band contact 28, which gets in contact with and is electrically connected to the base frame conductor 19, is provided along an outer surface of one end part of the external connection moving conductor 25.

The external connection band contact 28 remains in electrical contact with the base frame conductor 19, irrespective of the change in the position of the mover 21 for the closing and opening of the circuit. That is, the external connection band contact 28 on the external connection moving conductor 25, even if the external connection moving conductor 25 is in the connected state, maintains the contact with the base frame conductor 19 during the sliding movement.

An anti-rotation slot 29 is provided on an outer surface of the external connection moving conductor 25 in the direction of the length of the external connection moving conductor 25. An anti-rotation pin (not shown), which is protruding from the inside surface of the base frame conductor 19 as shown in FIG. 5, is engaged with the anti-rotation slot 29 to allow the external connection moving conductor 25 to move in the straight line direction, without rotating. A guide pin 25 provided on the external connection moving conductor 25 is engaged with the guide slot 24 provided on the internal connection moving conductor 23 to allow the internal connection moving conductor 23 to move in the straight line direction, without rotating.

The internal connection moving conductor 23 moves straight towards the fixed contact point 33, when the shaft 41 rotates clockwise or counterclockwise while the external connection moving conductor 25 and the internal connection moving conductor 23 stay within the base frame 11 as shown in FIG. 4B. The internal connection moving conductor 23 moves forwards until the guide pin 26 meets an inside wall (now shown) of the guide slot 24 which is positioned adjacent to the external connection moving conductor 25, as shown in FIG. 5. Thereafter, when the shaft continues to rotate clockwise or counterclockwise, the external connection moving conductor 25 is hauled by the internal connection moving conduct 23 and begins to move in the straight line towards the fixed contact point 33 until the anti-rotation pin on the base frame conductor 19 meets an inside wall of the anti-rotation slot 29. At this point, the internal connection band contact 27, which is provided on the one end part of the internal connection moving conductor 23, gets in contact with the fixed contact point 33 as shown in FIG. 5, generating the passage of the current, i.e., the connected state.

In the connected state, when the shaft 41 rotates reversely, the internal connection moving conductor 23 moves away from the fixed contact point 33 in the straight line and stays within the external connection moving conductor 25. Thereafter, when the shaft 41 continues to rotate reversely and as a result the guide pin 26 meets an inside wall of the guide slot 24 which is positioned adjacent to the internal connection band contact 27, the external connection moving conductor 25 begins to move back towards the base frame 11 and finally stays within the base frame 11 as shown in FIG. 4B. At this point, the internal connection band contact is spaced enough and surface-distanced enough from the fixed contact point 33, thus closing the passage of the current.

A type of double-structured moving conductor is above described, which includes the internal connection moving conductor 26 and the external connection moving conductor 25. Another type of single-structured moving conductor is available, which is a physical combination of the internal connection moving conductor 26 and the external connection moving conductor 25. That is, the mover 21 is formed as a single body which has a cylinder-shaped empty space inside. The band contact is provided along each of outside surfaces of both end regions of the single body which functions as the mover 21. A screw thread corresponding to the screw thread 43 of the shaft 41 are formed on the inside surface of the mover 21. An anti-rotation slot corresponding to the anti-rotation slot 29 into which the anti-rotation pin protruding from the base frame conductor 19 is inserted are formed on the outside surface of the mover 21. The mover 21 moves back and forth only in the straight line direction, irrespective of rotation of the shaft 41. This enables the mover 21 to open and close the circuit. The mover 21 which belongs to the type of single moving conductor has simpler structure than the mover 21 which belongs to the type of double moving conductor. However, the mover 21 which belongs to the type of single moving conductor requires the spacer 51 to be longer to secure the suitable insulation distance, thus increasing the length of the disconnection switch 100.

For reduction of the size of the disconnection switch, it is preferable to use the type of double-structured moving conductor, which is above described for explanation purpose. Another type of triple-structured moving conductor is available to further reduce the size of the disconnection switch 100.

The type of triple-structured moving conductor uses an intervening conductor (now shown) which has an inside empty space through which to pass the internal connection moving conductor 23 and passes itself through the external connection moving conductor 25. A guide slot corresponding to the guide slot 24 with which the guide pin 26 is engaged is formed on the intervening conductor in the direction of the length of the intervening conductor. A guide pin corresponding to the guide pin 26 with which the guide slot 24 on the internal connection moving conductor 23 is engaged is formed on the intervening conductor.

Another type of multiple-structured moving conductor (e.g., quadruple-structured moving conductor) is available if the number of the intervening conductors is provided which are necessary for the multiple-structured moving conductor. The description of the multiple-structured moving conductor is here omitted without which a person of ordinary skill in the art can understand the structure and function of the multiple-structured moving conductor.

Referring to FIGS. 8A to 9B, a configuration and operation of the power transfer assembly 71 according to the present invention is now described.

As shown in FIGS. 8A to 9B, the power transfer assembly 71 includes a single power transfer unit 71' or a plurality of transfer units 71', depending on a rated voltage required of the make/break apparatus within which the disconnection switch is installed.

The power transfer unit 71' provided between the driving assembly and the shaft includes at least one rotator 75 which is rotated by the driving assembly and rotates the shaft, a pair of housings 73 made of an insulating solid material which support the rotator and enable the rotator to rotate, and the plate provided between the pair of the housing 73. The plate 91 is above described which has the corrugated region 92 to lengthen the surface insulation distance and therefore the description of the plate 91 is omitted here.

Each of both sides of the rotator 75 faces the housing 73 through a central opening 93 of the plate 91. The rotator 75, as shown in FIG. SC, is practically circle-shaped. A protruding axis region is formed on one central side of the rotator 75 and an axis-receiving region is formed on the other central side of the rotator 75. Thus, the protruding axis region of one rotator 75 can be perfectly fitted into the axis-receiving region of another rotator 75 to assemble the two rotators. A ID small distance needs to exist between the rotator 75 and the housing 73 to allow the rotator 75 to rotate. The distance of 1 mm is preferable to allow the rotator 75 to rotate. An O-ring 77, which meets the preferable distance requirement, is provided between the rotator 75 and a facing surface of the housing 73 to maintain the preferable distance between the rotator 75 and the housing 73. This makes it possible to enable the rotators 75 to rotate between the pair of the housing 73 with a rotating friction being minimized.

The protruding axis region and the axis-receiving region formed on both sides of the rotator 75 make the surface distance of the rotator 75 larger. When the two rotators 75 are assembled, the surface distance of the rotator is increased two times. The rotator 75 not only transfers the rotating power generated by the driving assembly 61 to the shaft 41, but also provides the surface distance necessary to secure an electrical insulation between the driving assembly 61 and the base frame 11. According to the inventor's experiment, for example, the make/brake apparatus with the rate voltage of 24 KV or 25.8 KV needs five rotators 75 to guarantee the insulation. In this case, six housings 73 and five plates 91 are necessary as well. That is, three power transfer unit 71' are assembled as shown in FIG. 8C.

For example, a circle-shaped corrugated region 74 and a circle-shaped receding region 92 are provided on both sides of the housing 73, respectively. This makes it possible to secure the necessary insulation distance, as well as minimize the assembly size, when the housing 73 is assembled with the power transfer unit 71'. The corrugated or receding degree in the corrugated region 74 or the receding region 92 is changeable depending on the surface insulation distance varying with the rated voltage of the disconnection switch.

Figure 8B:
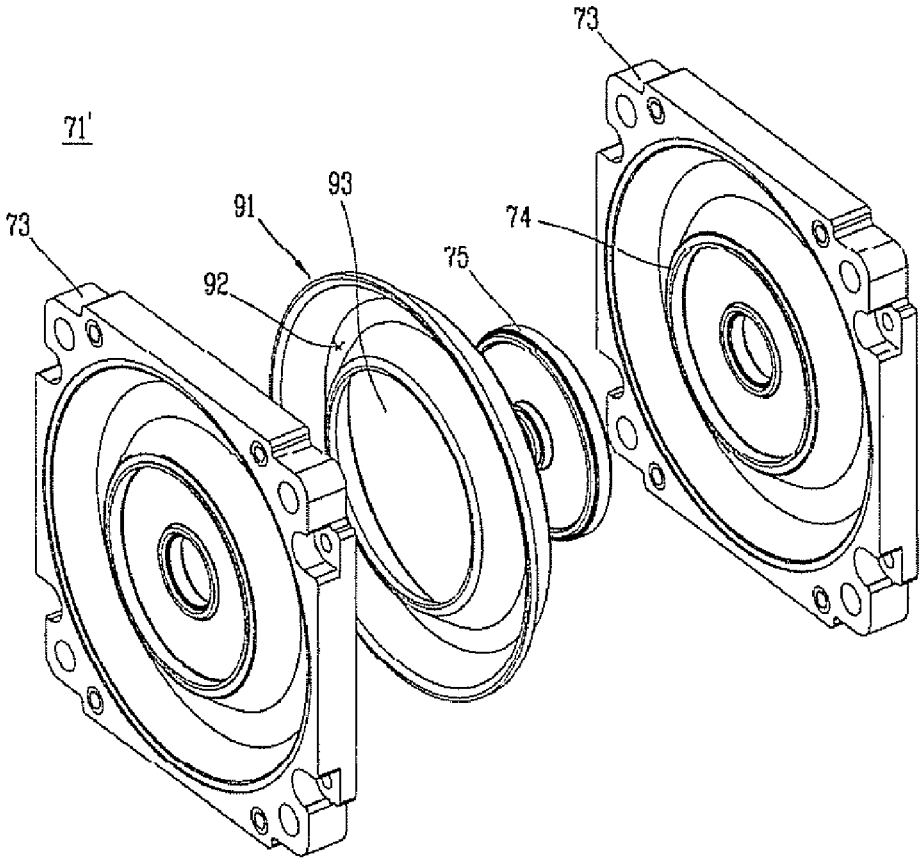
FIG. 8B is an exploded perspective view of a power transfer unit as shown in the FIG. 8A.
Figure 8C:
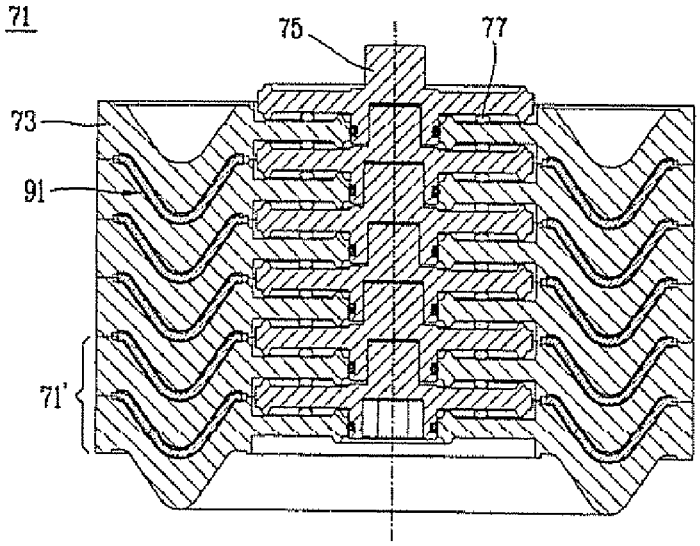
FIG. 8C is a cross sectional view of the power transfer assembly.

The size and shape of the power transfer unit 71' are not limited to those illustrated in FIG. 8B.

The above-described configuration of the power transfer unit 71' makes it possible to largely reduce the size of the power transfer assembly 71, thus reducing the whole size of the disconnection switch.

Figure 9A:
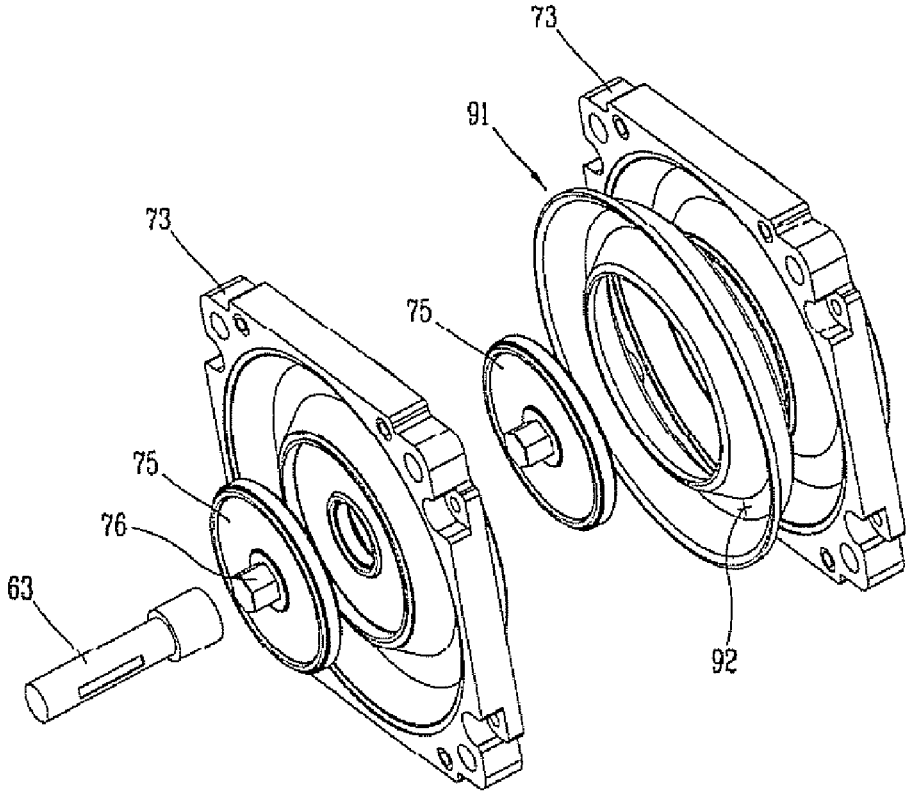
FIG. 9A is an exploded perspective view of the power transfer assembly.
Figure 9B:
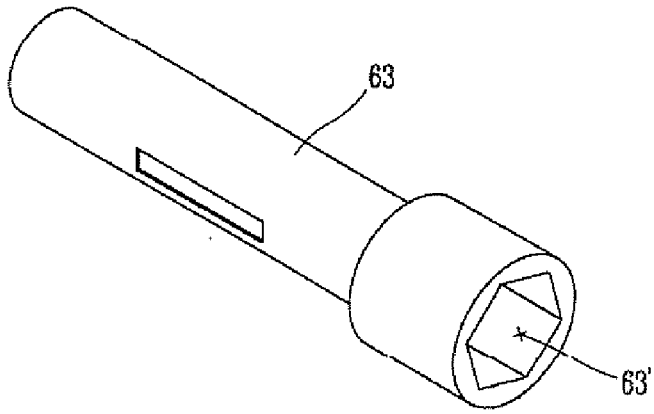
FIG. 9B is a perspective view necessary to explain about the combination way used in FIG. 9A.
Figure 10A:
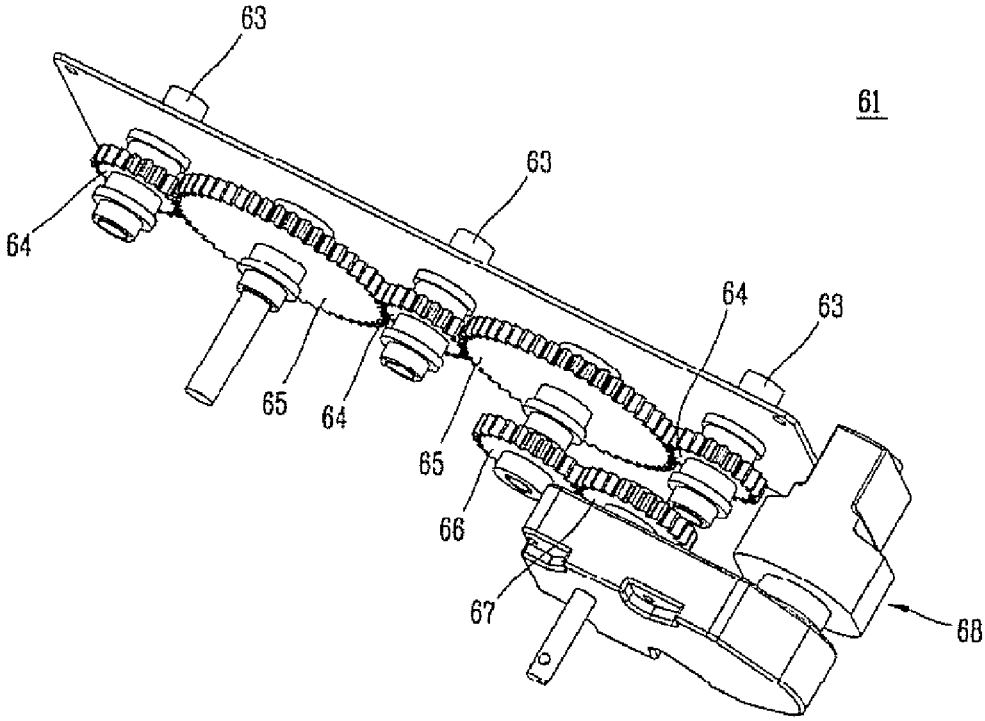
FIG. 10A is a perspective view of a driving assembly as shown in FIG. 4B.

There are many ways of connecting the power transfer assembly 71 and the rotator 75, the rotator 71 and a main rotation axis 63 of the driving assembly 61, and the rotator 71 and the shaft 41, respectively for their rotation. For example, one way of connecting and driving two components is that a corrugated region formed on one side of one component is fitted into a receding region formed on the facing one side of anther component. This way is employed in the embodiment of the present invention. The protruding axis 76 of the rotator 75 and one end region of the shaft 41, as shown in FIGS. 9A and 9B, are hexagon-shaped, while another end region of the main rotation axis 63 and an axis-receiving region (not shown, refer to FIG. 8C) formed on the opposite end of the region where the protruding axis 76 of the rotator 75 is formed have hexagon-shaped inside holes 63', Referring to FIGS. 10A and 10B, a configuration and operation of the driving assembly 61 which are components of the solid insulated disconnection switch 100 according to the present invention is now described.

Figure 10B:
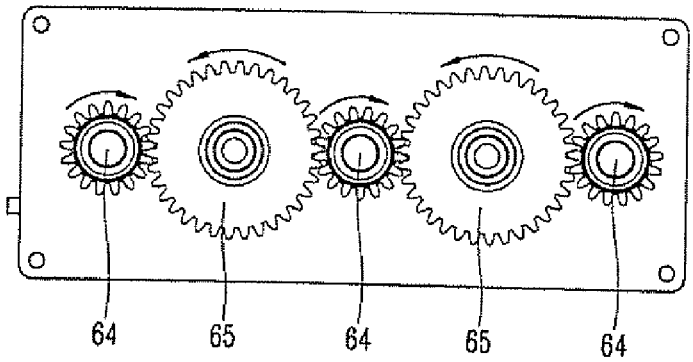
FIG. 10B is a view illustrating an operational relationship of FIG. 10A.

The solid insulated disconnection switch 100 according to the present invention is used in a case of the three phase alternating current. Three solid insulated disconnection switch, which correspond to R, S, and T, are provided in parallel with each other to constitute an assembly of the solid insulated disconnection switch The driving assembly 61 generally includes three main rotation gears 64, two auxiliary gears 65, and a motor 68 driving the three main rotation gears 64 and two auxiliary gears 65. Each of the main rotation gears 64 is combined with each of the insulating solid disconnection switch units 100 i.e., each of the main rotation shafts 63 which are connected to and driven by the protruding axis 76 of the rotator 75. The auxiliary gear 65 is provided between the main rotation gears and engaged with the main rotation gears 64 as shown in FIG. 10B. A driving gear 67, which receives the rotating power generated by the motor 68, rotates a connection gear 66. The connection gear 66 is provided on the same axis as one of the auxiliary gear 65.

Unlike in the conventional disconnection switch, the electricity-flowing components of the disconnection switch according to the embodiments of the present invention are covered with the insulating solid material, except for the driving assembly. It is possible to reduce the size of the disconnection switch by largely lengthening the surface insulation distance, even if the length of the insulating solid material is made short.

The prefabricated main components make it easier to assemble the components into the disconnection switch. The disconnection switch according to present invention uses the solid material as the insulating material, instead of SF6 gas which is the main culprit increasing the atmosphere temperature, thus removing everyday maintenance operations such as the cleaning of main buses, the checking of the gas pressure, the gas supply to compensate for gas leakage, or the like.

The disconnection switch according to the present invention is useful in adopting the double main buses.

Two disconnection switches using the gas are provided in parallel with each other to use the double main buses. In this case, the two disconnection switches are connected through a connection tube filled with the gas. Additionally, other works and components are necessary to install the two disconnection switches using the gas.

However, the disconnection switch according to the embodiments of the present invention does not require the connection tube and other components when two disconnection switches are installed. The overall reduction of the size of the disconnection switch does not require the parallel arrangement of two or more disconnection switches.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the metes and bounds of the claims, or equivalents of such metes and bounds are therefore intended to be embraced by the appended claims.

What is claimed is:

1. A solid insulated disconnection switch comprising:

a base frame made of an insulating solid material which is tunneled in one direction and has inside an external connection outlet to which outside electrical equipment is electrically connected;

a driving assembly generating rotating power;

a shaft made of the insulating solid material, of which an outside surface has a screw thread and which is rotated by the rotating power generated by the driving assembly;

a stator having a fixed contact point which is electrically connected to a main bus and is surrounded by the insulating solid material,;

a mover which is electrically connected to the external connection outlet of the base frame through the screw-thread engagement of the mover with the shaft and moves back and forth in a straight line between the fixed contact point of the stator and a position which is separately disconnected from the fixed contact point of the stator by rotating the shaft;

a spacer made of the insulating solid material, which is provided between the base frame and the stator to electrically insulate the base frame from the stator and has an empty space inside to allow the mover to pass through; and a power transfer assembly which is provided between the driving assembly and the shaft to transfer the rotating power generated from the driving assembly to the shaft and electrically insulate the driving assembly from the shaft.

2. The solid insulated disconnection switch according to claim 1, wherein the driving assembly, the power transfer assembly, the base frame, the spacer and the stator is sequentially provided in the straight line.

3. The solid insulated disconnection switch according to claim 1, further comprising a plate made of the insulating solid material, which is provided in at least one space of a space between the power transfer assembly and the base frame, a space between the base frame and the spacer, and a space between the spacer and the stator, and has a corrugated region to lengthen a surface insulation distance.

4. The solid insulated disconnection switch according to claim 1, wherein the shaft is provided in a manner that the shaft can pass through the mover to provide power to enable the mover to move in the straight line, one end of the shaft is supported and rotation-enabled within the stator, the other end of the shaft is connected to the power transfer assembly to drive the shaft, and screw threads are formed on an outside surface of the shaft and an inside surface of the mover, respectively, to enable the shaft to move into the mover through the screw-thread engagement of the shaft with the mover, and wherein an anti-rotation slot is formed on an outside surface of the mover to permit the mover to move in the straight line when the shaft rotates, and an anti-rotation pin is formed on the base frame from which the anti-rotation pin protrudes to be inserted into the anti-rotation, thereby preventing the mover from rotating and allowing the mover to move in the straight line.

5. The solid insulated disconnection switch according to claim 1, wherein the base frame comprises:

the external connection outlet having an external connection conductor; and a base frame conductor which is electrically connected to the mover.

6. The solid insulated disconnection switch according to claim 5, wherein the external connection outlet comprises at least one of a protruding outlet and a receding outlet which are made of a conducting material and are fixed to and electrically connected to the base frame conductor provided on an inside surface of the base.

7. The solid insulated disconnection switch according to claim 1, wherein the mover is formed as a single body and a band contact is provided along each of outside surfaces of both end regions of the single body.

8. The solid insulated disconnection switch according to claim 1, wherein the mover comprises:

an internal connection moving conductor which is connected to the shaft through the screw-thread engagement of the internal connection moving conductor with the shaft and is enabled to move back and forth between a position where the internal connection moving conductor is disconnected from the stator and a position where the internal connection moving conductor is connected to the stator by the rotation of the shaft; and an external connection moving conductor which is connected to the internal connection moving conductor to be driven and is enabled to move in the straight line in the same direction as the internal connection moving conductor moves in the straight line.

9. The solid insulated disconnection switch according to claim 8, wherein the internal connection moving conductor has an empty space inside, a screw thread is formed on an inside surface of the internal connection moving conductor, a guide slot is formed on the outside surface of the internal connection moving conductor, and an internal connection band contact is provided along an outer surface of a stator-faced end region of the internal connection moving conductor, thereby enabling the internal connection band contact to be connected to the fixed contact point of the stator;

wherein an inside diameter of the external connection moving conductor is greater than the outside diameter of the internal connection moving conductor to enable the internal connection moving conductor to move back and forth into the external connection moving conductor, and an external connection band contact is provided along an outer surface of one end region of the external connection moving conductor to enable the external connection band contact to electrically be connected to the external connection outlet of the base frame, and a anti-rotation slot is provided on the outer surface of the external connection moving conductor along its lengthwise direction to enable a anti-rotation pin protruding from the inside surface of the base frame conductor to be inserted into the anti-rotation slot and thereby allow the external connection moving conductor to move in the straight line direction without rotating;

and wherein a guide pin into which to insert the internal connection moving conductor is provided to prevent the internal connection moving conductor from rotating and obtain power to move in the straight line through the contact of the guide pin with one inside wall of the guide slot on the internal connection moving conductor.

10. The solid insulated disconnection switch according to claim 8, wherein the mover has a plurality of intervening conductors, each of which has an empty space inside, between the internal connection moving conductor and the external connection moving conductor.

11. The solid insulated disconnection switch according to claim 1, wherein an inside surface of the space has a corrugated region.

12. The solid insulated disconnection switch according to claim 1, wherein the power transfer assembly comprises:

at least one rotator provided between the driving assembly and the shaft which is rotated by the driving assembly and rotates the shaft; and a housing made of the insulating solid material which support the rotator and enable the rotator to rotate.

13. The solid insulated disconnection switch according to claim 1, wherein the power transfer assembly comprises:

at least one rotator which is shaped like a circle and has a protruding region formed on one central side of the rotator and an axis-receiving region formed on the other central side of the rotator to fit the protruding axis region of one rotator into the axis-receiving region of another rotator; and at least a pair of housings made of the insulating solid material which support the rotator and enable the rotator to rotate; and a plate made of the insulating solid material, which is provided between the pair of the housings, wherein the housing and the plate has their respective corresponding protruding region and receding region to tightly fit the housing and the plate into each other when combining both the housing and the plate.

14. The solid insulated disconnection switch according to claim 1, wherein the driving assembly comprises:

a main rotation axis which is connected to the power transfer assembly to be rotated;

a main rotation gear rotating together with the main rotation axis; and a motor rotating the main rotation gear.

15. The solid insulated disconnection switch according to claim 1, wherein the shaft is made of an insulating enhanced plastic and the base frame and the spacer is made of insulating epoxy resin.

16. The solid insulated disconnection switch according to claim 3, wherein the plate is made of insulating silicone.

17. The solid insulated disconnection switch according to claim 12, wherein the housing is made of insulating epoxy resin.

* * * * *